US007655054B2

(12) United States Patent
Weathersbee

(10) Patent No.: US 7,655,054 B2
(45) **Date of Patent: *Feb. 2, 2010**

(54) METHOD OF FORMING A GLOW THROUGH CANDLE

(75) Inventor: Nicolas A. Weathersbee, St. Petersburg, FL (US)

(73) Assignee: Global Candle Gallery Licensing Company, Apollo Beach, FL (US)

( * ) Notice: Subject to any disclaimer, the term of this patent is extended or adjusted under 35 U.S.C. 154(b) by 558 days.

This patent is subject to a terminal disclaimer.

(21) Appl. No.: 11/229,361

(22) Filed: Sep. 16, 2005

(65) Prior Publication Data

US 2007/0062099 A1 Mar. 22, 2007

(51) Int. Cl.

| | |
|---|---|
| ***C10L 5/00*** | (2006.01) |
| ***C10L 7/00*** | (2006.01) |
| ***C11C 5/00*** | (2006.01) |
| ***F23Q 2/32*** | (2006.01) |

(52) U.S. Cl. ..... 44/275; 431/126

(58) Field of Classification Search ..... 44/275; 431/44, 126; 425/117; 264/271, 271.1
See application file for complete search history.

(56) References Cited

U.S. PATENT DOCUMENTS

| | | | | |
|---|---|---|---|---|
| 1,825,785 | A | 10/1931 | Finn, Jr. | |
| 2,817,225 | A | 12/1957 | Weglin | |
| 2,841,972 | A | 7/1958 | Weglin | |
| 3,266,272 | A | 8/1966 | Fredericks | |
| 3,867,173 | A * | 2/1975 | Putzer | 117/39 |
| 3,983,677 | A | 10/1976 | Lundbom | |
| 4,096,299 | A | 6/1978 | Stewart | |
| 4,386,904 | A | 6/1983 | Miyahara et al. | |
| 5,019,424 | A | 5/1991 | Strelnieks | |
| 5,597,300 | A | 1/1997 | Wohl et al. | |
| 5,910,005 | A * | 6/1999 | Scherr | 431/126 |
| 6,079,975 | A | 6/2000 | Conover | |
| 6,450,802 | B1 | 9/2002 | Steck | |
| 7,004,752 | B2 * | 2/2006 | Weathersbee | 431/288 |
| 2003/0049577 | A1 * | 3/2003 | Steck | 431/288 |
| 2006/0006582 | A1 * | 1/2006 | Strelnieks | 264/330 |

* cited by examiner

*Primary Examiner*—Cephia D Toomer
*Assistant Examiner*—Pamela Weiss
(74) *Attorney, Agent, or Firm*—Larson & Larson, P.A.; Frank Liebenow

(57) ABSTRACT

A wax core is dipped multiple times in liquid clear wax and water sequentially. Thereafter, the candle is dipped multiple times in a first liquid pigmented wax to form a first pigmented layer. When the desired shade is achieved, one or more layers of clear wax are added followed by dipping in water after each clear layer is added to produce a primed surface layer at ±1 degree ambient. This sequence is continued by applying a second pigmented wax layer to three-quarters of the candle ball, a third pigmented wax layer to one-half of the candle ball, and a fourth pigmented wax layer to one-quarter of the candle ball. An outside white wax is formed by dipping the ball into white wax in preparation for adding an outside color.

9 Claims, 16 Drawing Sheets

METHOD OF FORMING A GLOW THROUGH CANDLE

FIELD OF THE INVENTION

This invention relates to methods of manufacturing candles. More particularly, it refers to a method of manufacturing glow through candles of mixed colors.

BACKGROUND OF THE INVENTION

Paraffin waxes have been used to make candles for hundreds of years. Early candles were made by dipping a wick in molten paraffin ladled into molds. Upon cooling, the candle was ready for use. Additives were added to molten paraffin to color the wax, but many of the early additives interfered with the burning of the candle or caused toxic fumes contaminating the air in which the candles burned. Subsequently, pigments of either mineral or organic origin were developed which did not interfere with candle burning or contaminate the air around the burning candle. With such discovery, it was not long before candle makers started decorating candles such as shown in U.S. Pat. Nos. 2,817,225; 2,841,972; 4,096,299; and 6,450,802. Many different colors in a single candle provide more decorative patterns and are highly desirable. Dipping candles into a clear wax, then directly into colored wax, and blowing on the surface of the candle as it comes out of the colored wax has been the traditional way of making decorative patterns on candles. However, this procedure causes the wax to blend and separate giving a marble like effect. This procedure contaminates one color with another, losing the original color in time and the color becomes bland. Current techniques cannot produce candles that are free from the bleeding of one color layer into another. In addition, attempts have been made in the prior art to add pigmented waxes of one color over a pigmented wax of another color to form glow through candles. However, this has previously proved unsatisfactory in that the outer pigmented layer masks out the inner pigmented layer and therefore, cannot form multiple pigmented layers in a glow through configuration. A solution to these problems is needed to produce a glow effect when lit.

SUMMARY OF THE INVENTION

The present invention solves the problem of making glow through candles of varying shades or colors. The steps of this invention start with a traditional wax ball core containing a cotton wick. This core is dipped into liquid clear wax three to thirty times. The candle is cooled in water after each dipping. A first color layer is formed by dipping the candle two to ten times in a liquid pigmented or dyed wax. Each reference to pigmented wax hereafter also includes dyed wax.

When the pigment color has been achieved, one layer of clear wax is added by dipping in liquid clear wax. After cooling the outer surface of the candle is dipped in water. The candle ball is then dipped in a second liquid pigmented wax followed by the same sequence of water, but the ball is only dipped three-quarters of its core into the pigmented wax. One layer of clear wax is added by multiple dipping in liquid clear wax. The process is continued with dipping in a third liquid pigmented wax followed by the same sequence of dipping in water and dipping in a liquid clear wax, but the ball is only dipped one-half of its core into the pigmented wax. The process is continued by dipping one-quarter of the ball in a fourth and fifth liquid pigmented wax followed in each instance by dipping in water and followed by dipping in a liquid clear wax.

BRIEF DESCRIPTION OF THE DRAWINGS

The invention is best understood by those having ordinary skill in the candle making art by reference to the following detailed description when considered in conjunction with the accompanying drawings in which.

DETAILED DESCRIPTION OF THE INVENTION

Figure 1:
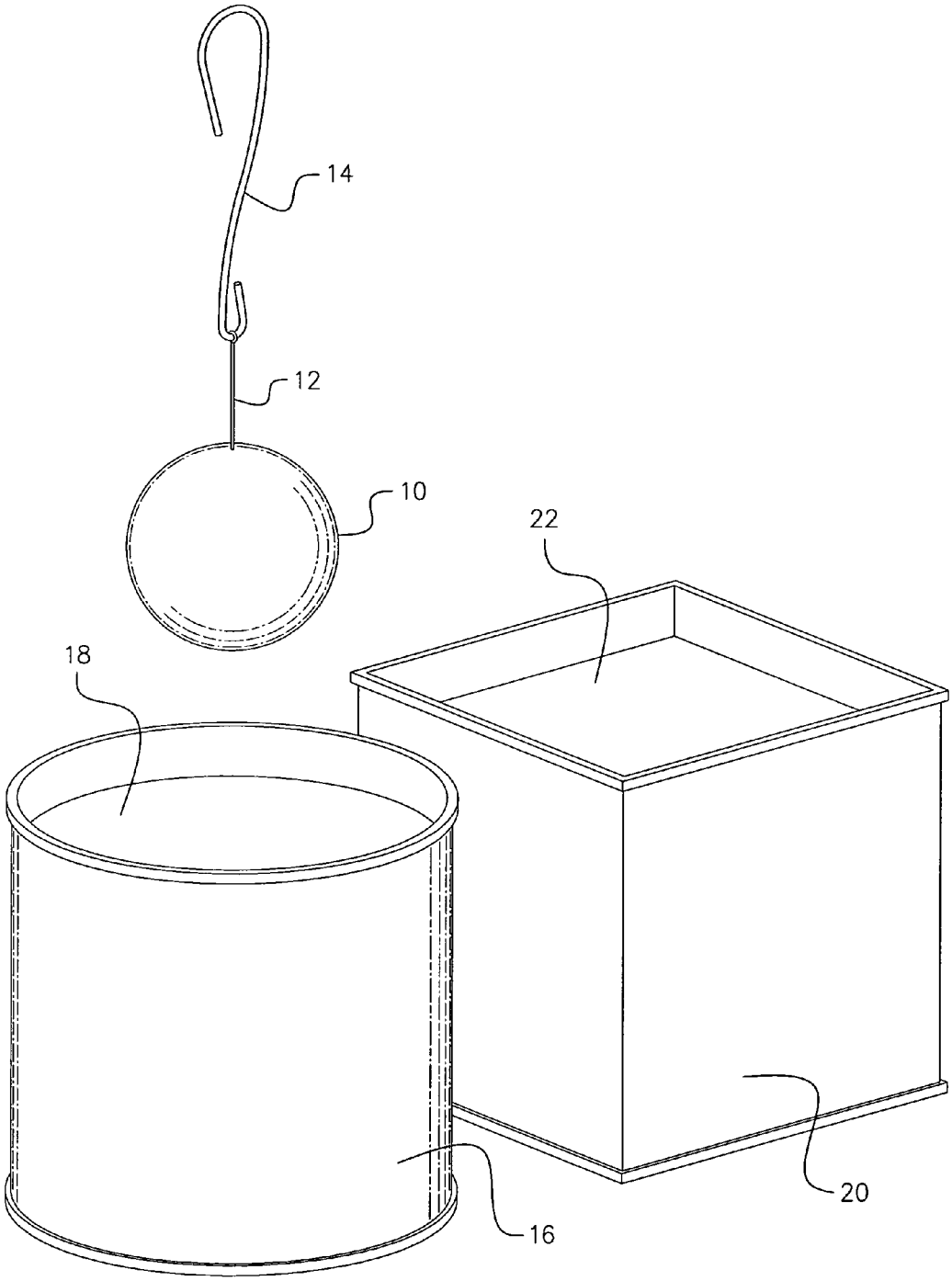
FIG. 1 shows wax core with wick tied to a hanger.

Throughout the following detailed description, the same reference numerals refer to the same elements in all figures.

Figure 2:
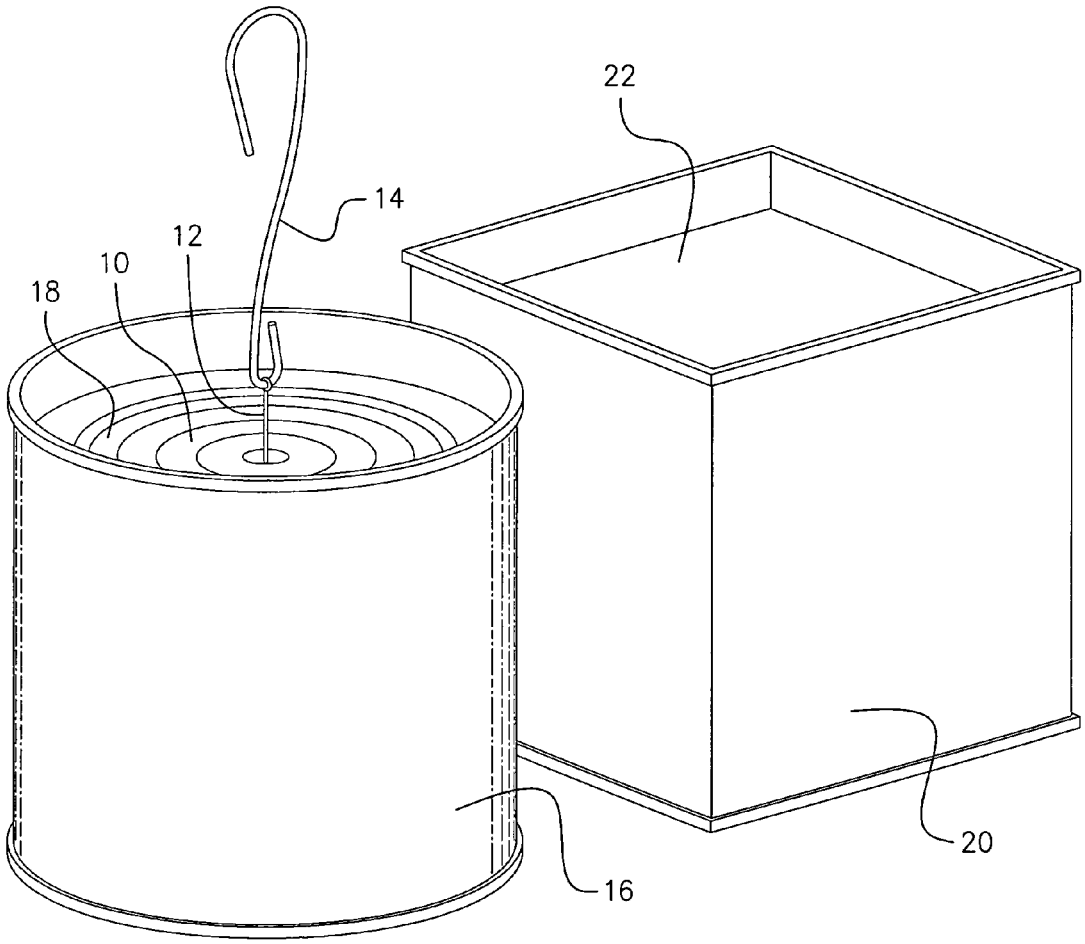
FIG. 2 shows core being dipped into liquid clear wax.
Figure 3:
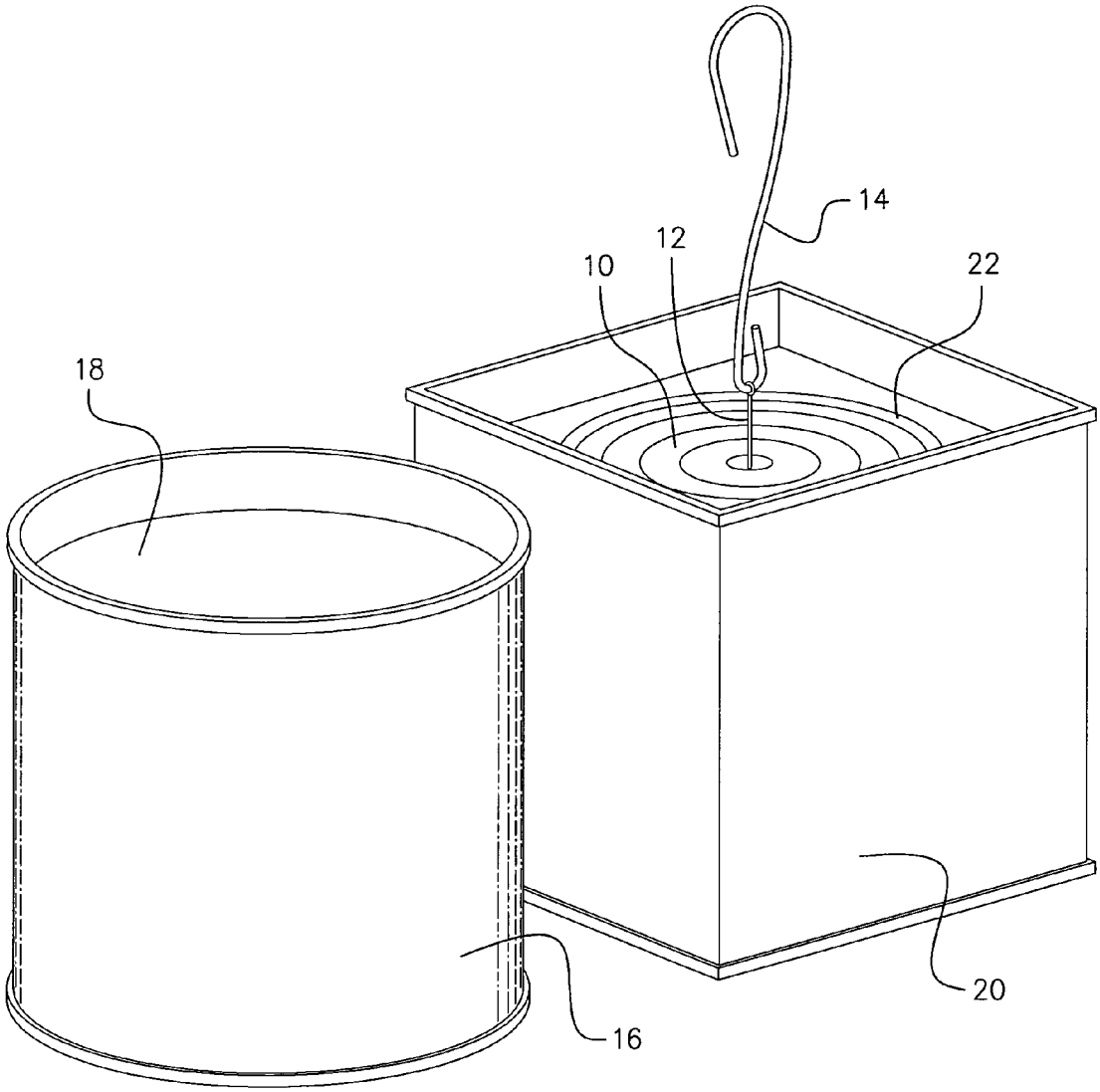
FIG. 3 shows core with exterior clear wax layer being dipped into water.
Figure 4:
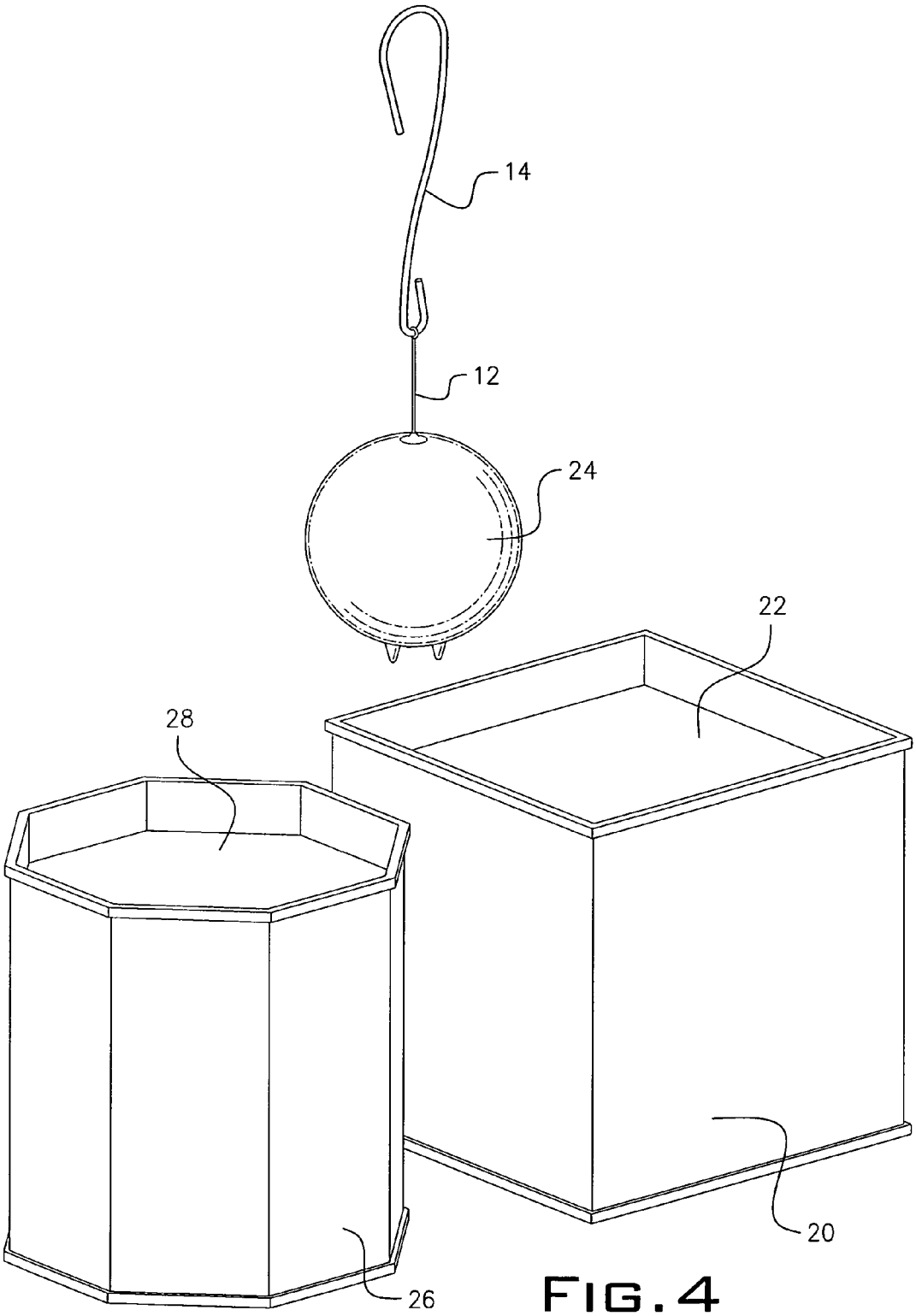
FIG. 4 shows candle about to be dipped into a liquid pigmented wax.
Figure 5:
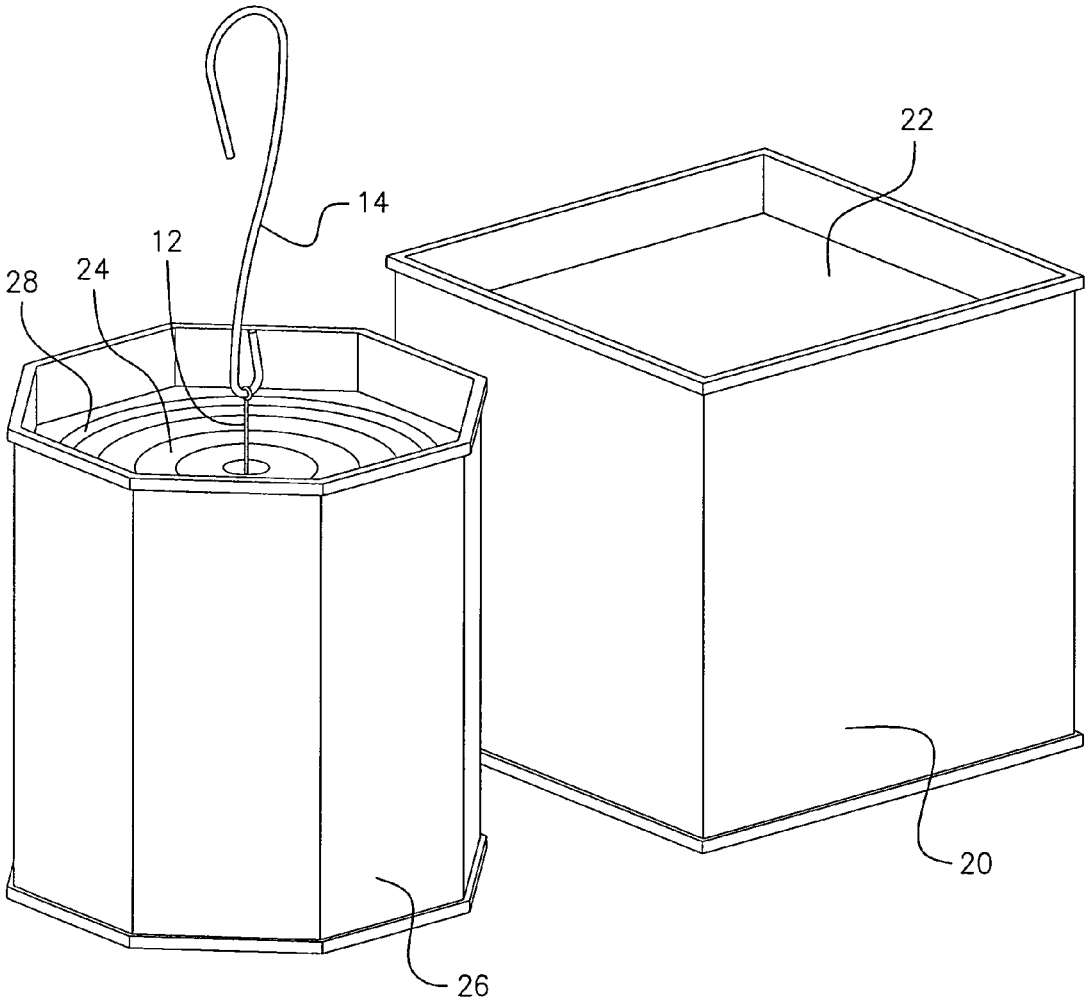
FIG. 5 shows candle dipped into liquid pigmented wax.
Figure 6:
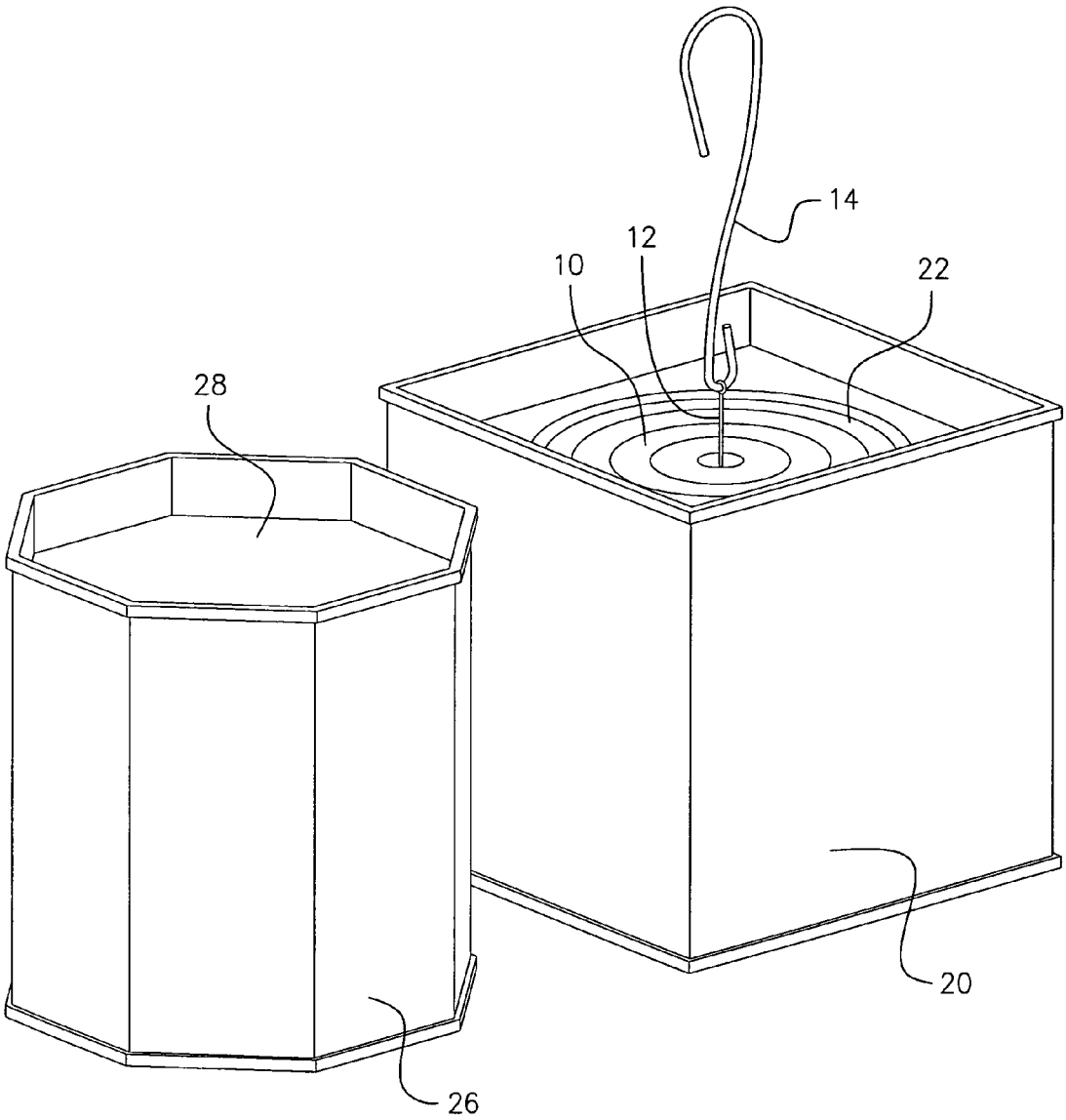
FIG. 6 shows candle being dipped into water.
Figure 7:
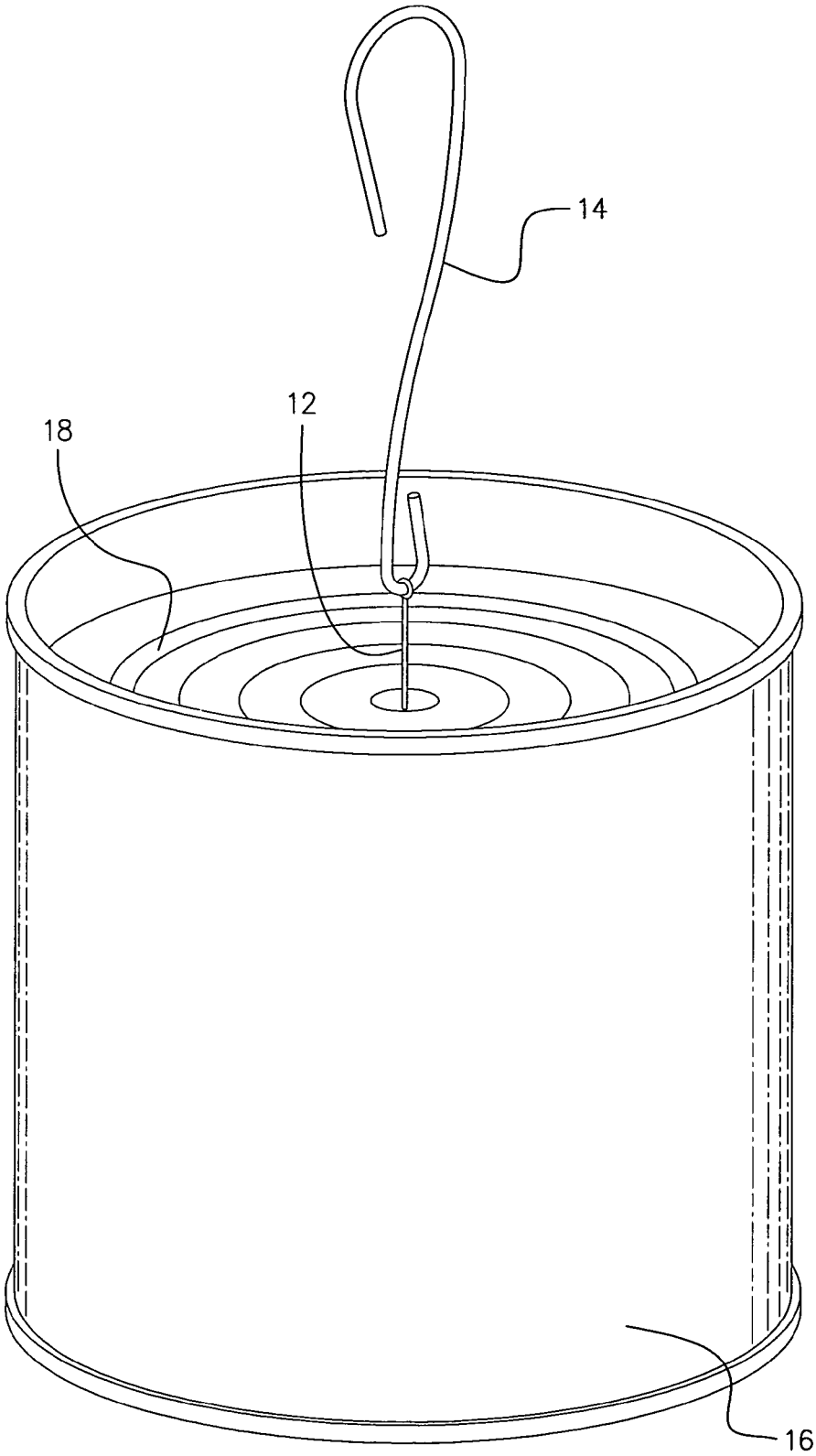
FIG. 7 shows candle dipped into liquid clear wax.
Figure 8:
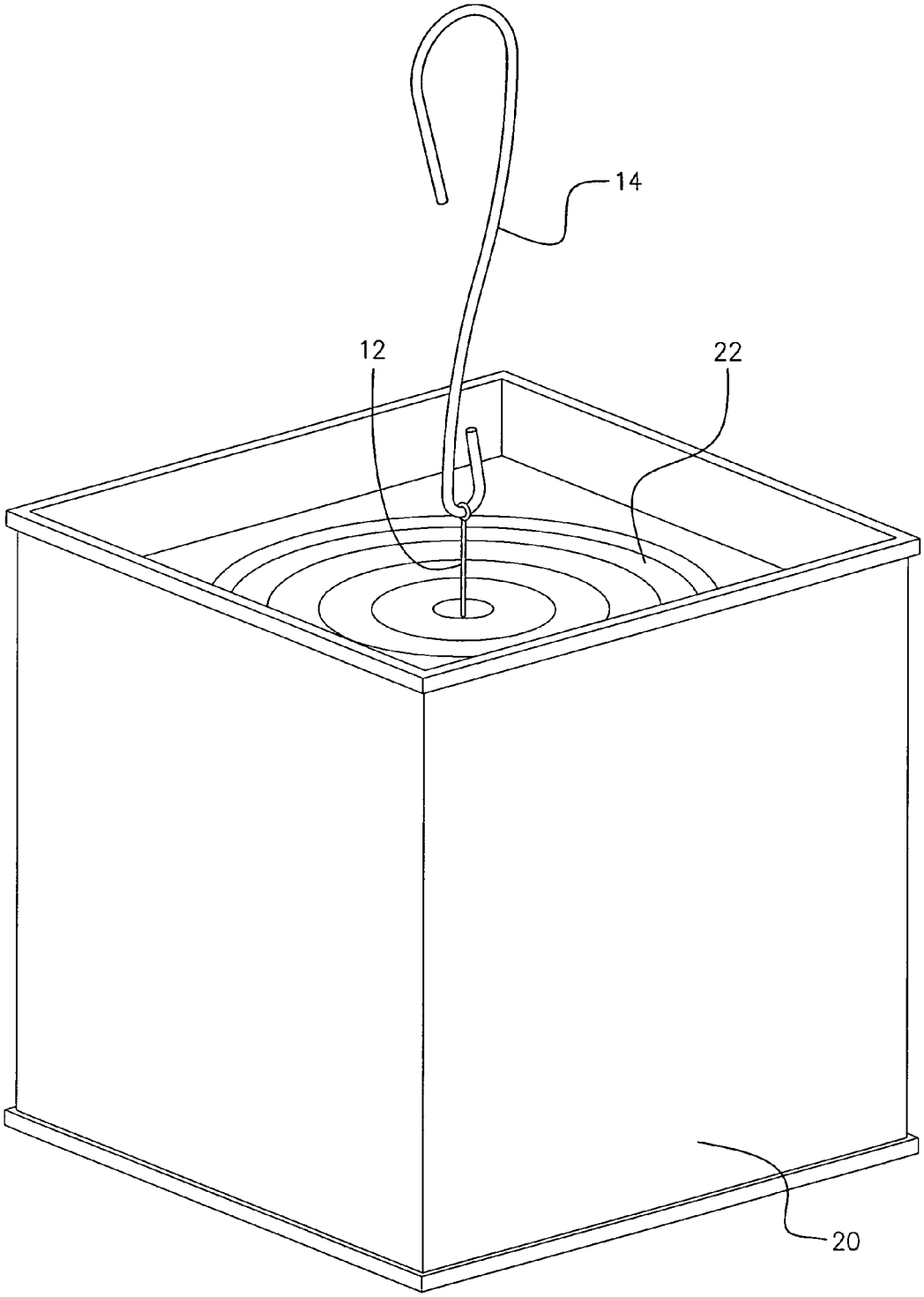
FIG. 8 shows candle dipped into water.

Referring to FIGS. 1-3, a core wax ball 10 has a wick 12 through approximately the wax ball's centerline. The wick is tied to a hanger 14 for further processing. First, the wax ball 10 is dipped into a container 16 containing a liquid clear wax 18 at a temperature of about 125 to 195 degrees F., and thereafter, in a tub 20 containing water 22. The steps of FIGS. 2 and 3 are sequentially repeated multiple times. About ten dips in clear wax and water is usually sufficient to form an exterior clear wax layer 24 seen in FIG. 4. The clear wax layer 24 is then dipped in a tub 26 containing a liquid pigmented wax 28 at a temperature of about 125 to 195 degrees F., as seen in FIG. 5 and thereafter in tub 20 containing water 22. The steps of FIGS. 5 and 6 are repeated one or more times until a desired pigment shade is achieved. When the desired pigment shade is obtained the colored candle 30 is dipped again one or more times into liquid clear wax 18 and water 22 as seen in FIGS. 7 and 8 until a candle temperature of about ±1 degree F. ambient is obtained.

Figure 9:
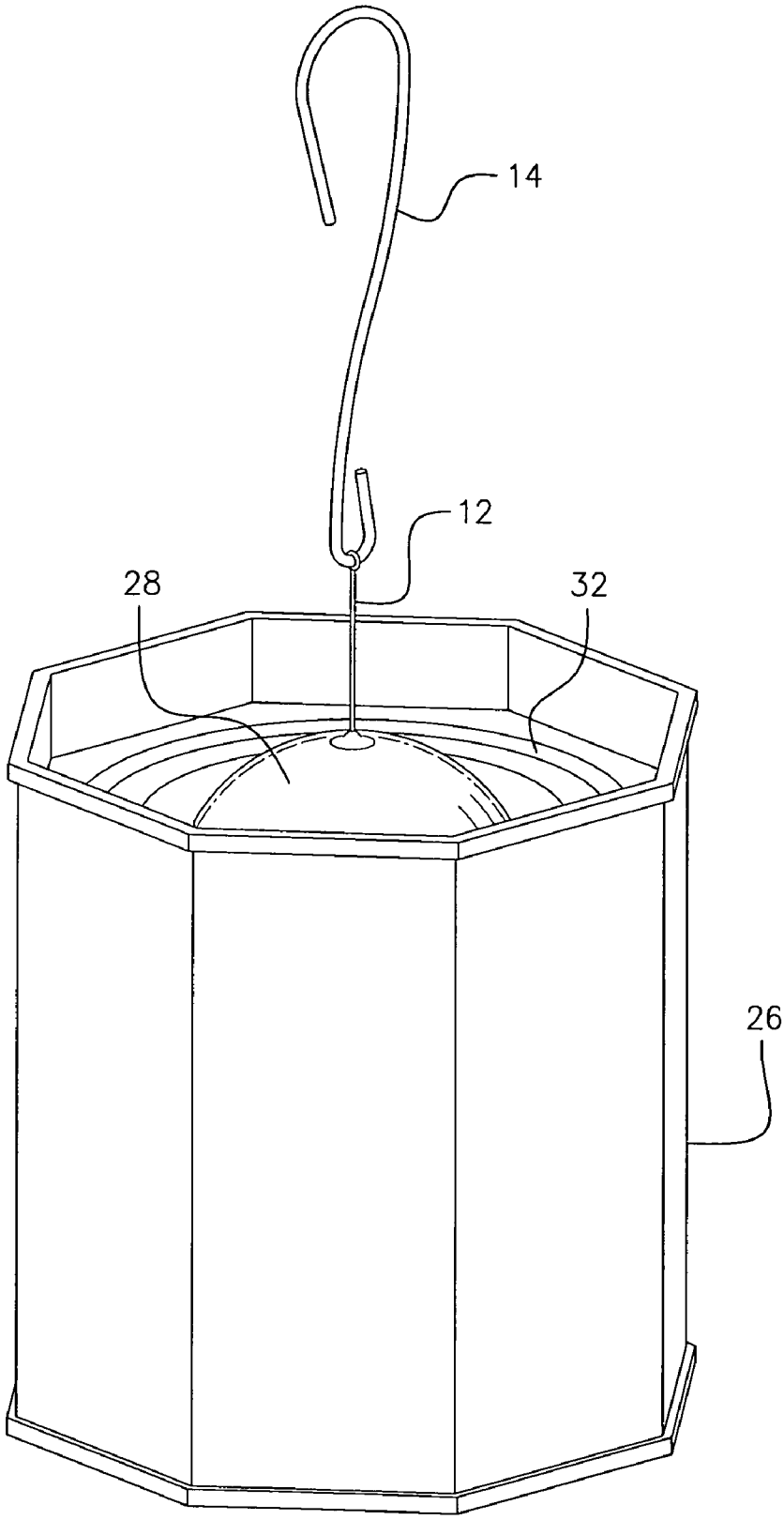
FIG. 9 shows three-quarters of the candle dipped into a selected pigment.

The ball 10 is then dipped three-quarters of its core into a second pigmented wax 32 multiple times as seen in FIG. 9.

Figure 10:
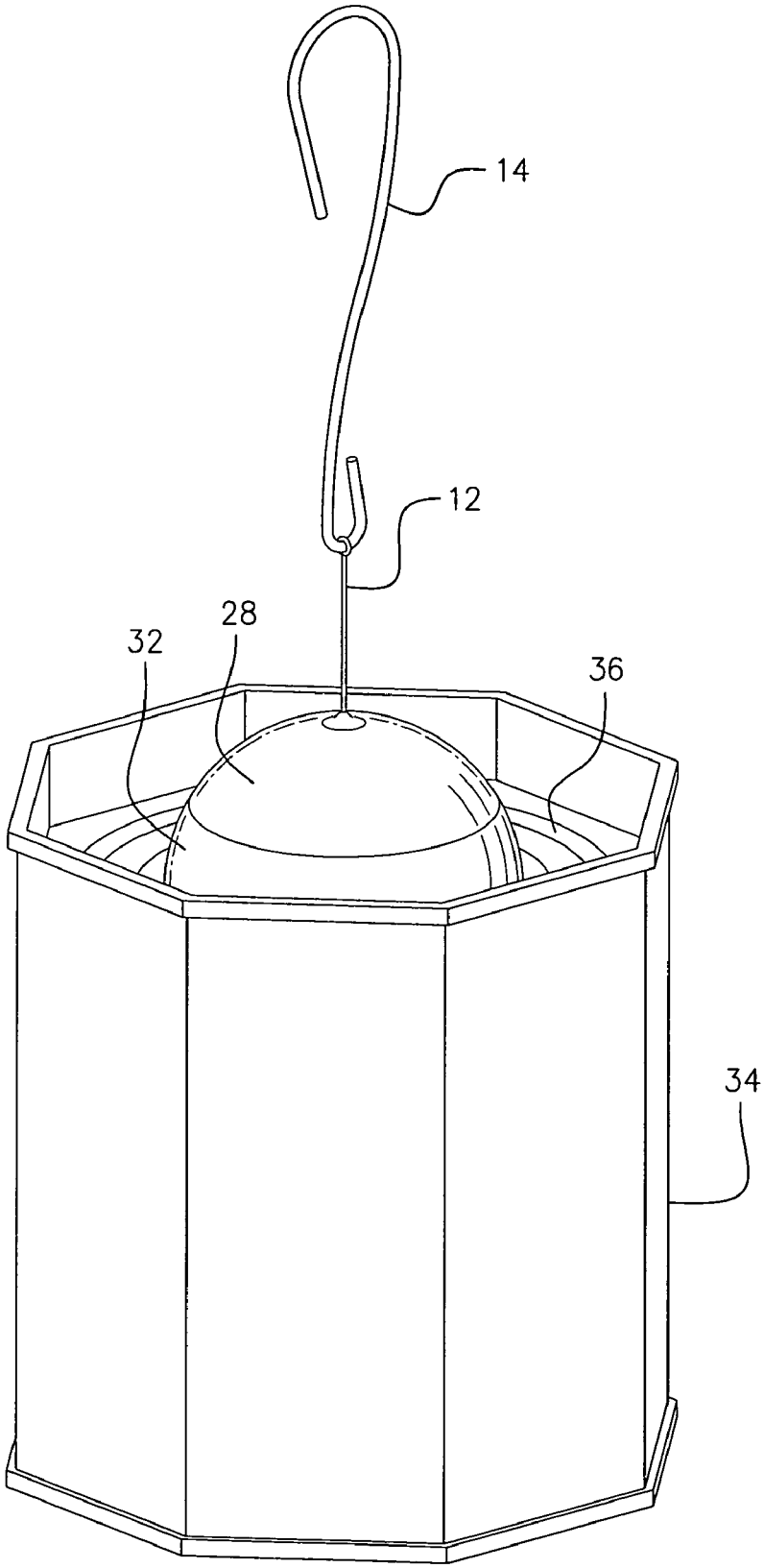
FIG. 10 shows one-half of the candle dipped into a selected pigment.
Figure 11:
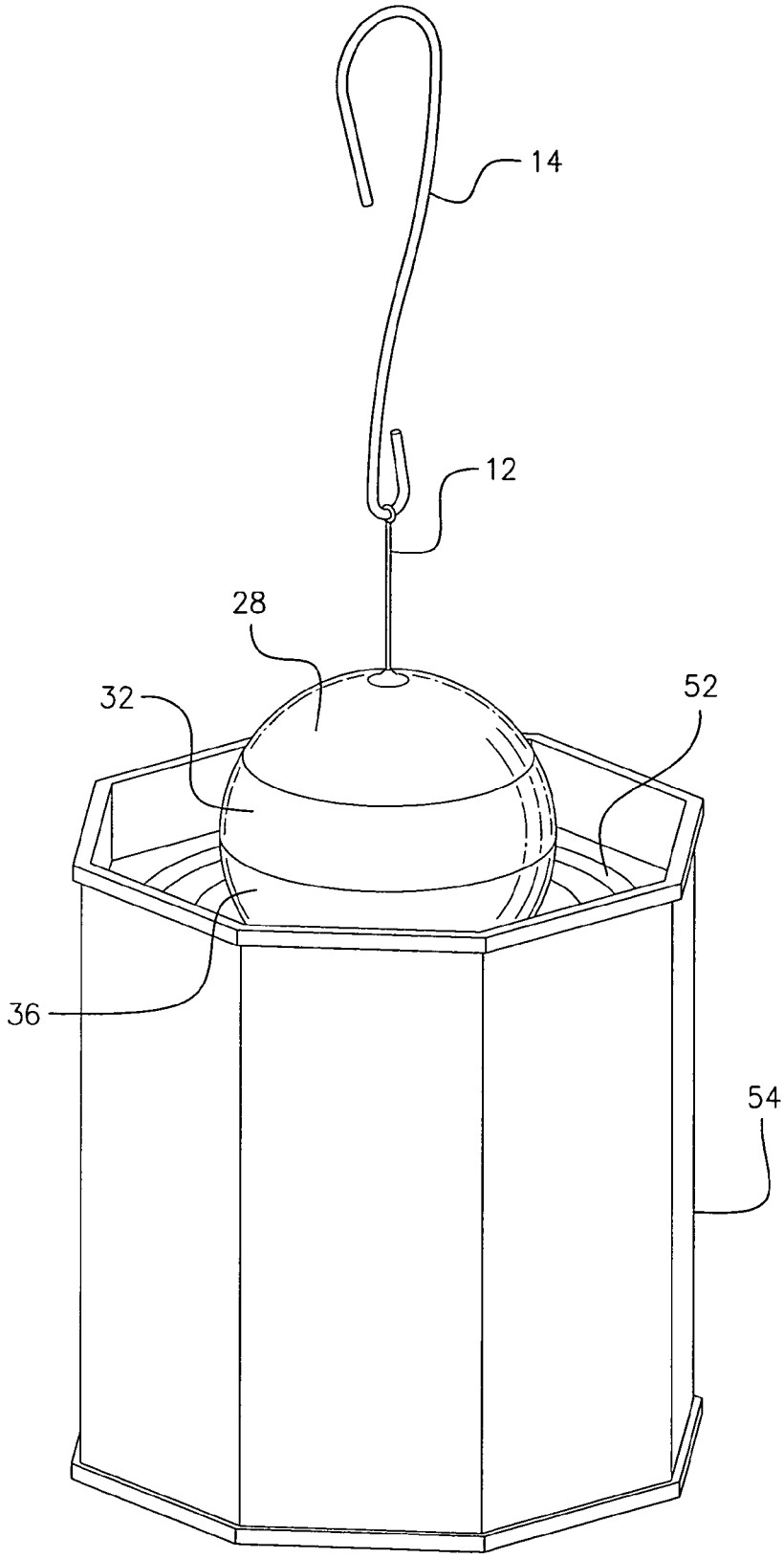
FIG. 11 shows one-quarter of the candle dipped into a selected pigment.
Figure 12:
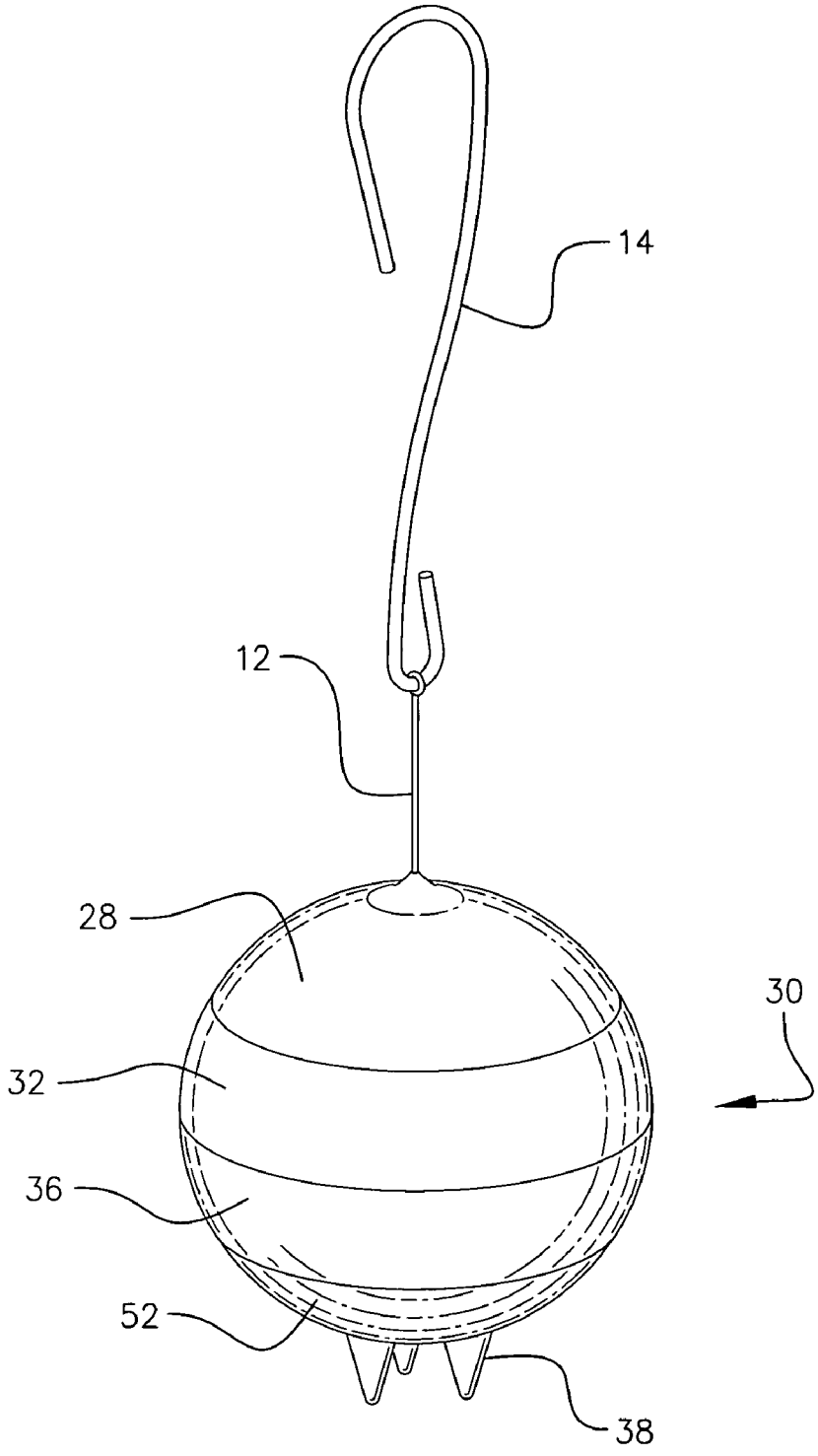
FIG. 12 shows candle after desired multiple layers have been applied.
Figure 13:
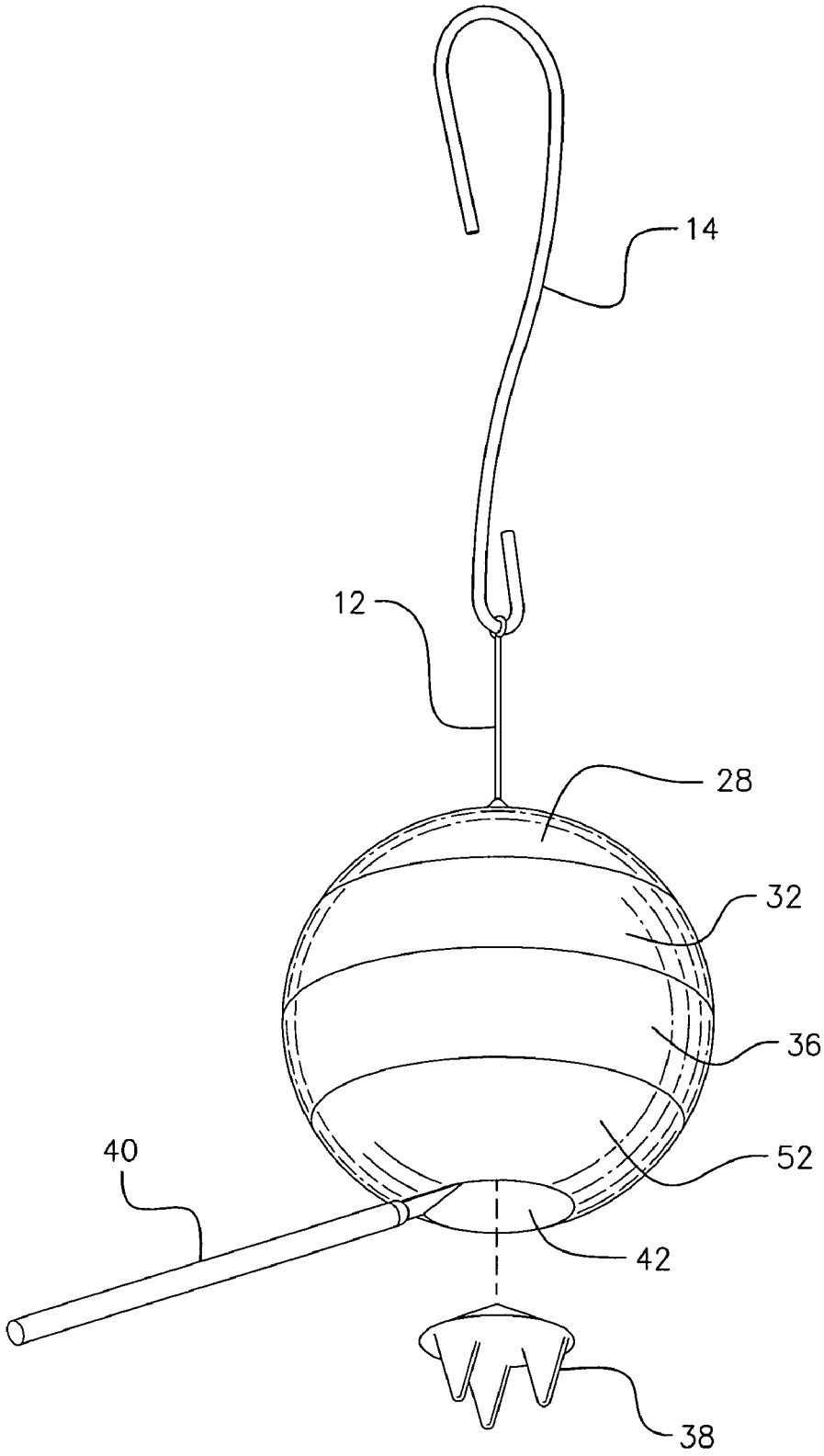
FIG. 13 shows candle bottom layer drippings being removed to create a flat bottom.
Figure 14:
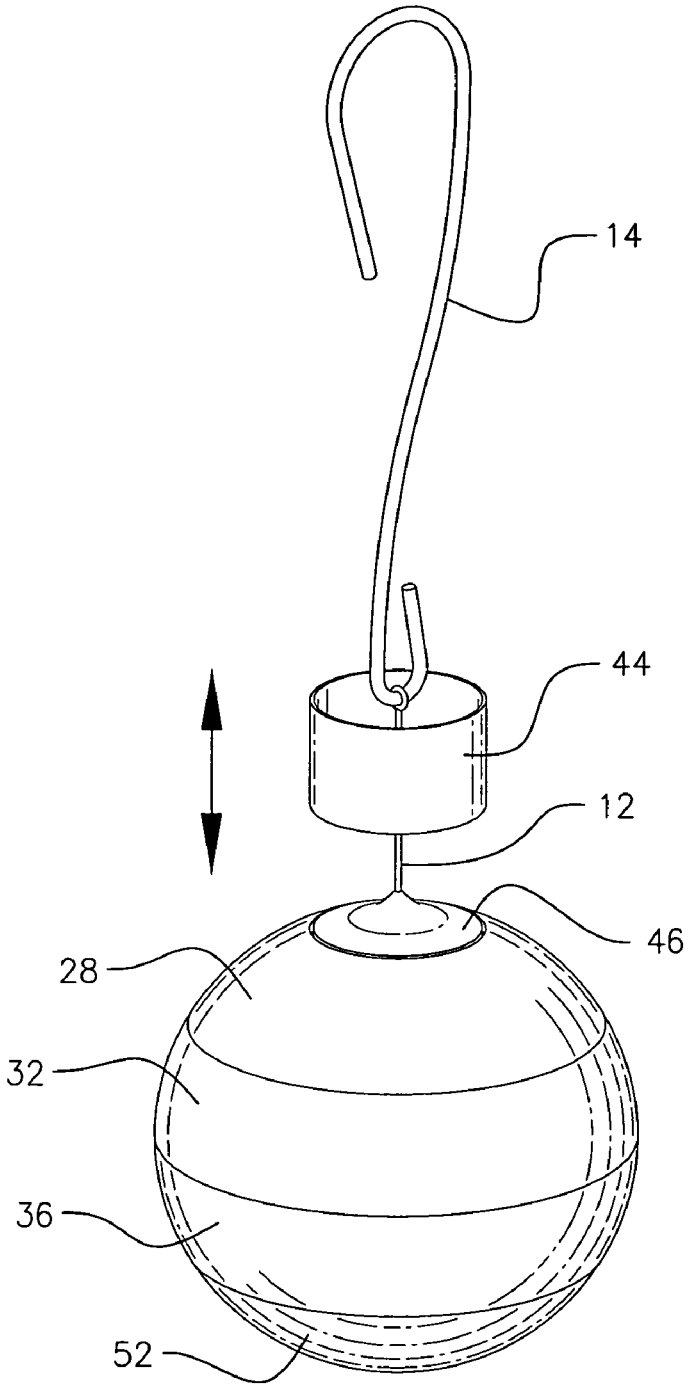
FIG. 14 shows top cutter being used to mark the non-cut area on top of the candle.
Figure 15:
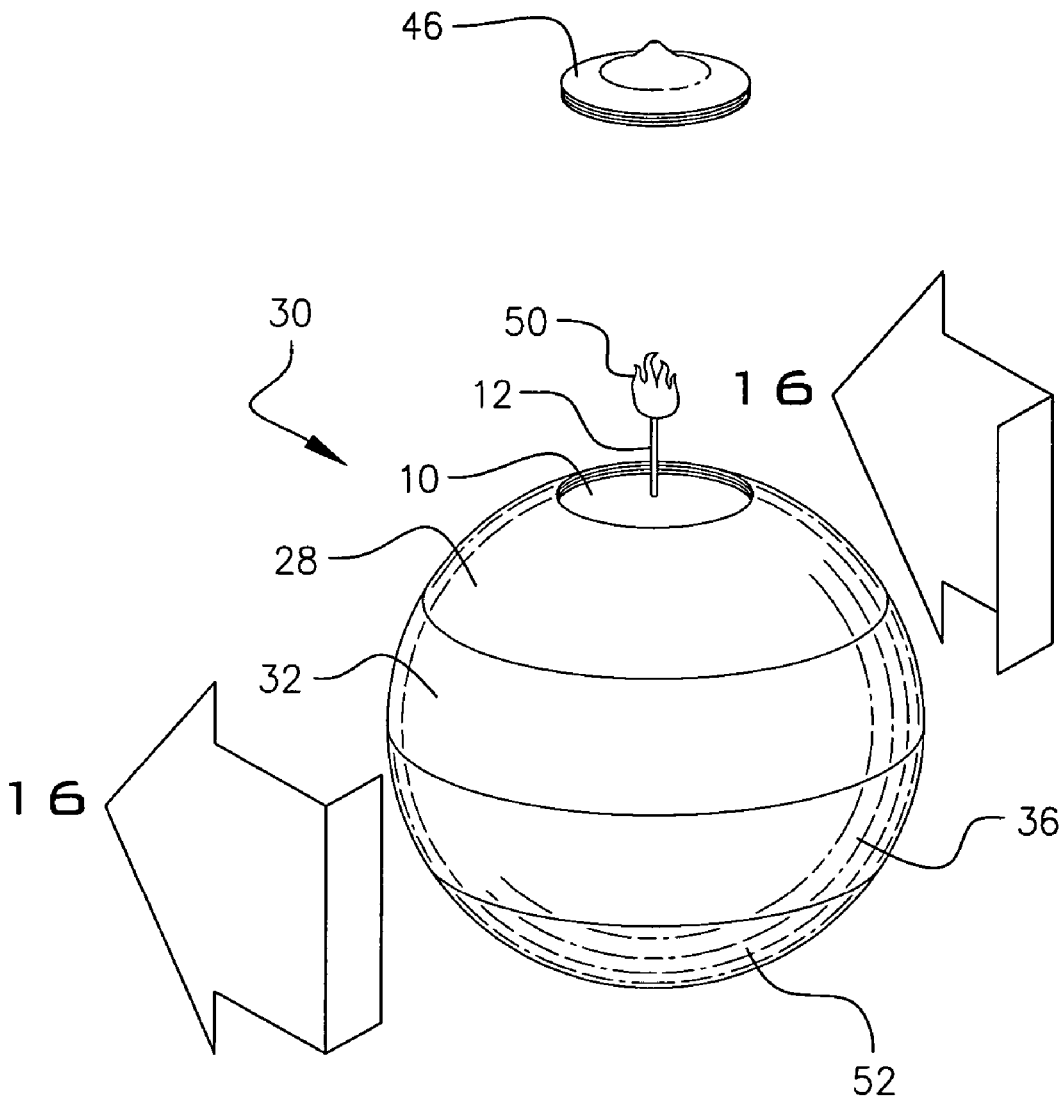
FIG. 15 shows the glow through candle.

The candle containing the second layer 32 then goes through the process of multiple dippings in liquid clear wax 18 and water, usually two to ten times to create another layer prior to applying a third pigmented layer. The candle is then dipped one-half as seen in FIG. 10 in a third pigmented wax tub 34 containing a third liquid pigmented wax 36 and sequentially a water tub 20. The dipping in tub 34 and tub 20 continues until a desired third color shade is achieved to create a third exterior color 36.

Additional layers of pigmented color 52 can be added by repeating the steps shown in FIGS. 10-14, but only dipping the ball one-quarter into the pigmented wax. The entire ball can be dipped now in a non-complimentary color to glow at the same time with other colors; i.e., red glow with green glow, or blue glow with a yellow glow. The colors will not mix to form other colors because of the intermediate layers of clear wax. The following Example illustrates the inventive process.

EXAMPLE

After preparing a core with multiple layers of clear wax as described above, the clear wax containing ball is dipped three-quarters of the way up with a green wax pigment. This is followed by dipping four times in clear wax followed each time by dipping in water. The ball is then dipped one-half of the way up with the green wax pigment, followed again with dipping in clear wax and water four times. The ball is then dipped one-quarter of the way up with the green wax pigment, followed again with dipping in clear wax and water four times. The entire ball is then dipped in a red pigment followed by dipping in water. This allows the top one-quarter of the candle to glow red and the lower three-quarters of the candle different shades of green.

The color combinations for an outside color can be solid, gradating or with a marble effect or even a combination of all three.

The core should not be dipped from one wax to another before dipping in water or the wax on the core will super heat and cause the wax layers to split.

The use of clear wax in multiple layers between each application of a pigmented layer provides the infinite glow combinations of this inventive process. The various pigmented layers 28, 32, 36 or 52 can be the same color pigment or different color pigments as required.

Figure 16:
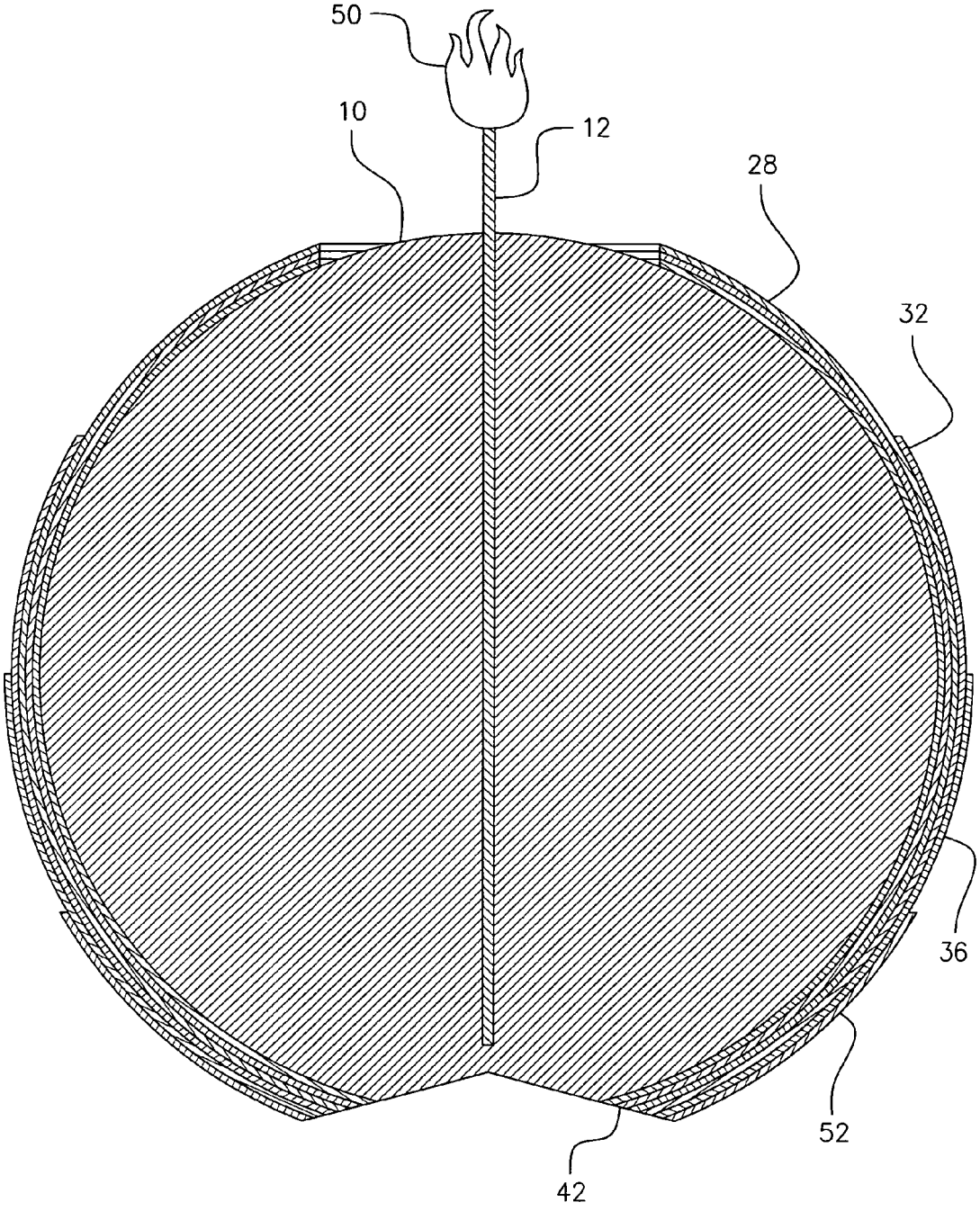
FIG. 16 is a sectional view of the multilayered colored candle along lines 16-16 in FIG. 15.

The bottom drippings 38 are cut off with a knife 40 to form a slight concave indentation 42 in the bottom of the candle. An annular cutter 44 is used to mark a non-cut area 46 as seen in FIG. 16.

Subsequently, after an outer clear wax layer 18 has been added, the candle is dipped into container 54 containing a white pigment liquid 52. The final candle product 30 has the cut-away top 46 removed and the wick 12 cut. When lighted 50, the entire ball will glow through the pigmented layers.

The preferred pigment color is Caribbean Blue and Christmas Red. However, many other pigments can be employed.

The wax can be a paraffin, beeswax, soy wax or hemp oil wax. Paraffin is preferred.

Other equivalent steps can be substituted for the steps set forth above to produce substantially the same results in substantially the same way.

Having disclosed the invention, what is claimed follows:

1. A process for producing a decorative glow through candle, the process comprising:

(a) dipping a wax core containing a wick into a liquid clear wax multiple times in sequence with dipping the wax core into water;

(b) dipping the wax core coated by the process of step (a) into a first liquid pigmented wax one or more times in sequence with dipping the wax core into the water to form a pigmented wax ball;

(c) dipping the pigmented wax ball of step (b) into the liquid clear wax multiple times in sequence with dipping the pigmented wax ball into the water;

(d) dipping three-quarters of the pigmented wax ball of step (c) into a second liquid pigmented wax multiple times in sequence with dipping the pigmented wax ball into the water;

(e) dipping the pigmented wax ball of step (d) multiple times in the liquid clear wax followed in sequence by dipping the pigmented wax ball into the water;

(f) dipping one-half of the pigmented wax ball of step (e) into a third liquid pigmented wax multiple times followed in sequence by dipping the pigmented wax ball into the water;

(g) dipping the pigmented wax ball of (f) containing the third liquid pigmented wax into the liquid clear wax multiple times followed in sequence with dipping the pigmented wax ball into the water;

(h) dipping one-quarter of the pigmented wax ball of step (g) multiple times into a fourth liquid pigmented wax followed in sequence by dipping the pigmented wax ball into the water;

(i) dipping the pigmented wax ball of step (h) containing the fourth liquid pigmented wax into the liquid clear wax multiple times followed in sequence with dipping the pigmented wax ball into the water;

(j) dipping the pigmented wax ball of step (i) multiple times into a white wax followed in sequence by dipping the pigmented wax ball into the water; and (k) dipping the pigmented wax ball of step (j) multiple times in an outside color liquid pigmented wax followed in sequence by dipping the pigmented wax ball into the water.

2. The process for producing a decorative glow through candle according to claim 1, wherein air is blown on a surface of the pigmented wax ball after the pigmented wax ball is removed from dipping into a selected pigment of the first, second, third, fourth or outside color liquid pigmented wax to create a marbled appearance.

3. The process for producing a decorative glow through candle according to claim 1, wherein each of the first, second, third and fourth liquid pigmented wax employed in steps (b), (d), (f) and (h) is different from each other of the first, second, third and fourth liquid pigmented wax.

4. The process for producing a decorative glow through candle according to claim 1, wherein the liquid clear wax is provided in a container maintained at a temperature of about 125 to 195 degrees F.

5. The process for producing a decorative glow through candle according to claim 1, wherein the first, second, third and fourth liquid pigmented wax is provided in a container maintained at a temperature of about 125 to 195 degrees F.

6. The process for producing a decorative glow through candle according to claim 1, wherein a dripping at the bottom of the candle is removed with a concave cut into the bottom of the candle.

7. The process for producing a decorative glow through candle according to claim 1, wherein a top portion of the candle is removed after dipping in the outside color liquid pigmented wax.

8. The process for producing a decorative glow through candle according to claim 1, wherein the first, second, third, fourth, and outside color liquid pigmented wax is a paraffin wax.

9. The process for producing a decorative glow through candle according to claim 1, wherein the first, second, third, fourth, and outside color liquid pigmented wax is a dyed wax.

* * * * *